United States Patent [19]

Anderson

[11] 4,378,884

[45] Apr. 5, 1983

[54] APPARATUS AND SYSTEM FOR THE DISPLAY AND SELECTION OF MERCHANDISE

[76] Inventor: David N. Anderson, 16210 Meadowcrest, Sherman Oaks, Calif. 91403

[21] Appl. No.: 248,515

[22] Filed: Mar. 27, 1981

[51] Int. Cl.[3] ..... B65D 73/00; A47F 7/00

[52] U.S. Cl. ..... 206/459; 211/59.1; 40/534

[58] Field of Search ..... 206/459, 44 R; 211/59.1, 54, 13; 40/534

[56] References Cited

U.S. PATENT DOCUMENTS

| | | | |
|---|---|---|---|
| 1,810,826 | 6/1931 | Gray | 206/459 |
| 3,040,448 | 6/1962 | Paxton | 211/13 |
| 3,200,960 | 8/1965 | Banse | 206/44 R |
| 3,799,357 | 3/1974 | Govang | 206/459 |
| 3,804,238 | 4/1974 | Howard | 206/459 |

*Primary Examiner*—William T. Dixson, Jr.
*Attorney, Agent, or Firm*—Poms, Smith, Lande & Rose

[57] ABSTRACT

A display sheet and placard for use with a pegboard type merchandise display wall has sequentially numbered display posts, each carrying merchandise of common characteristics. The display placard has multiple matrices, each corresponding to a particular configuration of merchandise, particularly plumbing fittings. The first and second axes of each matrix have independently variable required characteristics of the merchandise, particularly sizes of each respective end configuration of the fitting. The body of each matrix has numbers referring to the numbered display post carrying fittings having the desired characteristics and sizes indicated by the row and column of the first and second axes, respectively.

The placard or sheet may also provide graphic facsimiles or verbal descriptions of the characteristics or sizes of the fittings, descriptions of the manufacturer, instructions for use of the selection system, general characteristics of the merchandise displayed, and appropriate environments for use.

The placard is adapted so that it may be mounted with the display sheet as a unitary display surface such that the placard overlies and obscures from view a portion of the display sheet containing redundant information. Alternatively, the placard and sheet may be mounted separately, each referring to the other for use.

8 Claims, 8 Drawing Figures

APPARATUS AND SYSTEM FOR THE DISPLAY AND SELECTION OF MERCHANDISE

This invention relates generally to merchandise display apparatus and, more particularly, to apparatus for selecting merchandise having multiple combinations of independent characteristics, and having particular application to plumbing fittings.

BACKGROUND OF THE INVENTION

Display walls and graphics are generally known in the art of merchandise display and the graphics used with display walls may comprise a combination of photographic, line image, and written word media for describing and displaying available merchandise. One common method of packaging merchandise for display on a wall is to contain the merchandise in a bubble of plastic laminated to a cardboard backing. Another method is to insert the merchandise in a plastic bag with a paper or cardboard portion either inserted in the bag or folded over and attached to the top of the bag. In either case, the cardboard portion has printed matter descriptive of the contained merchandise and a hole punched in it so that the merchandise may be hung from display posts protruding from a display wall or surface. One such display post arrangement that is known in the art is the pegboard and post construction in which the display wall comprises a board of rigid material having multiple, evenly spaced holes extending through it. Display hangers used with such a pegboard have predetermined shapes with portions that extend through said holes and attach the hanger to the display wall. These hangers provide a protruding post on which merchandise may be hung in an orderly manner, suspended from the display surface.

It is also known in the art to provide paper or placard style covering materials which decoratively cover the pegboard surface. Covering materials may display additional graphics or printed matter relating to the displayed merchandise or its manufacturer.

In the field of plumbing fittings for connection with pipe or tubing, it has been difficult, utilizing the existing art, to organize and display fittings having a multitude of identifying characteristics in a manner which allows a customer to easily select the desired fitting while using a minimum of display space. Typically, plumbing fittings are available in a permutation of fitting types and sizes for each of their multiple ends. The more common fittings have one, two or three ends for connection with pipe or tubing, each of said ends may have one of three types of fitting configurations (tubing, male pipe, and female pipe), for each of said configurations there may be four or more common tubing or pipe diameters, and the fitting having two ends may provide either a straight connection or an elbow. Assuming four common tubing or pipe diameters, the possible permutations of the foregoing factors alone are in excess of one thousand. Less than one hundred of these permutations are commonly available but these still present a difficult problem for either the experienced or the inexperienced customer in selecting the desired fitting.

Further, the needs of customers vary. One customer may come in to a retail store with a particular fitting in hand which he desires to replace, a second customer may know the numeric size of the tubing or pipe which he desires to connect, and a third customer may only have a sample of the tubing or pipe that he desires to attach onto.

Prior to the present invention, no selection system or apparatus was known which efficiently facilitated the selection of merchandise from a display of merchandise having multiple characteristics. Further, no apparatus or system was known which could accommodate the various needs of customers which differ with the customer's knowledge of characteristics of the desired merchandise.

Accordingly, it is a principal object of the present invention to disclose and provide a method for selecting a piece of merchandise having specific characteristics from a display of merchandise of multiple combined characteristics where the selection system and apparatus is efficient, easy to use, and requires a minimum of display space.

It is a further object of the invention to disclose and provide a display selection apparatus and system that can accommodate multiple types of customer needs in the selection of their merchandise.

It is also an object of the present invention to disclose and provide a selection means and system for use with merchandise having two or more independent characteristics and which is easily adapted to and displayable on pegboard display surfaces which are commonly existing in retail stores.

SUMMARY OF THE INVENTION

The present invention discloses an apparatus and system for the display and selection of merchandise having a plurality of identifying characteristics. That apparatus and system basically comprises a display surface for displaying merchandise, multiple merchandise carrying means mounted to that surface and each carrying merchandise having common characteristics, multiple merchandise selection indicia located on the display surface proximate the merchandise carrying means and serving to identify merchandise carried by the associated merchandise carrying means, and a matrix of indicia carried on the display surface which has a first axis containing variations of one characteristic of the displayed merchandise, a second axis containing variations of a second characteristic of the displayed merchandise, and a body consisting of multiple rows and columns of selection indicia corresponding with the selection indicia of the particular merchandise carrying means, the selection indicia identified by the row and column of the body associated with desired characteristics of the merchandise identified in the first and second axes of the matrix, respectively, indicating a merchandise carrying means identified by the associated selection indicia which carries merchandise having the desired characteristics.

More particularly, one embodiment of the present invention for displaying plumbing fittings comprises a display surface which includes a placard having printed matter describing the manufacturer and general properties of the merchandise displayed on the display surface. The display surface includes a pegboard having multiple evenly spaced holes arranged in rows and columns. The display surface also includes multiple posts inserted in the holes of the pegboard for mounting merchandise and includes a pliant foldable sheet covering the pegboard and having apertures through which the posts may extend. Said sheet has printed matter which identifies the merchandise carried on each of the pegboard posts and which consecutively numbers the posts thereby making a particular post easily locatable.

A placard is provided having graphic and descriptive representations of several of the generic types of fitting characteristic combinations, particularly representations of the shape of the fitting (whether straight or elbow) and the particular fitting end configurations that are combined (whether combinations of tubing, male pipe, or female pipe couplings). For a particular combination of fitting configurations and shape, the placard contains an associated matrix in which diameters or sizes of the configuration of one end of the fitting are displayed on the vertical axis and sizes or diameters of the configuration of the other end of the fitting are displayed on the horizontal axis. The body of the matrix contains selection numbers corresponding with the numbers printed proximate each of the posts of the display surface. A user may locate a desired fitting by locating the size of the configuration of one end of the fitting on one axis, the size of the configuration of the other end of the fitting on the other axis, and locate in the body, in the row and column corresponding with said located sizes, the number of the pegboard display surface post which carries the fitting having said configurations and sizes. The combination of a description of the general characteristics of the fitting, a graphic representation, and a selection matrix may be repeated for each combination of configurations and fitting shapes.

In another feature of the preferred embodiment, the placard is further provided with graphic representations of diameters or sizes of tubing, threaded pipe, or the like. A customer may bring to the display the fitting that he desires to replace, hold the fitting proximate the display and determine by visual comparison of the graphic representations and the fitting to be replaced the numeric size of the fitting to be replaced. The customer may then use that size in an axis of the matrix to locate the replacement fitting.

In yet another feature of the preferred embodiment, both the display sheet and the placard are provided with indicia descriptive of the manufacturer and general characteristics of the merchandise carried by the display surface. Said display sheet and placard are provided with mounting apertures so that said placard may partially overlie said sheet in a predetermined manner when mounted on a pegboard surface such that redundant indicia may be obscured from view. Alternatively, said display sheet may be mounted alone on a pegboard surface and be complete in its identification of the manufacturer and general characteristics of the displayed merchandise while said placard may be separately and movably attached to the display wall by a chain or other fastening means and redundantly show the manufacturer and general identifying characteristics of the displayed merchandise sufficient to indicate that the placard is referable to and to be used in conjunction with the separately mounted display sheet.

In a further feature of the preferred embodiment, the display sheet may be further provided with printed matter comprising graphic and descriptive respesentations of the particular characteristics of the fittings carried by each of the pegboard posts. These representations are located proximate both the apertures for the post and the selection numbers.

Further objects, features and advantages of the present invention can be understood from a detailed discussion of the drawings and a description of a preferred embodiment of the invention as follows.

DETAILED DESCRIPTION OF A PREFERRED EMBODIMENT

Figure 1:
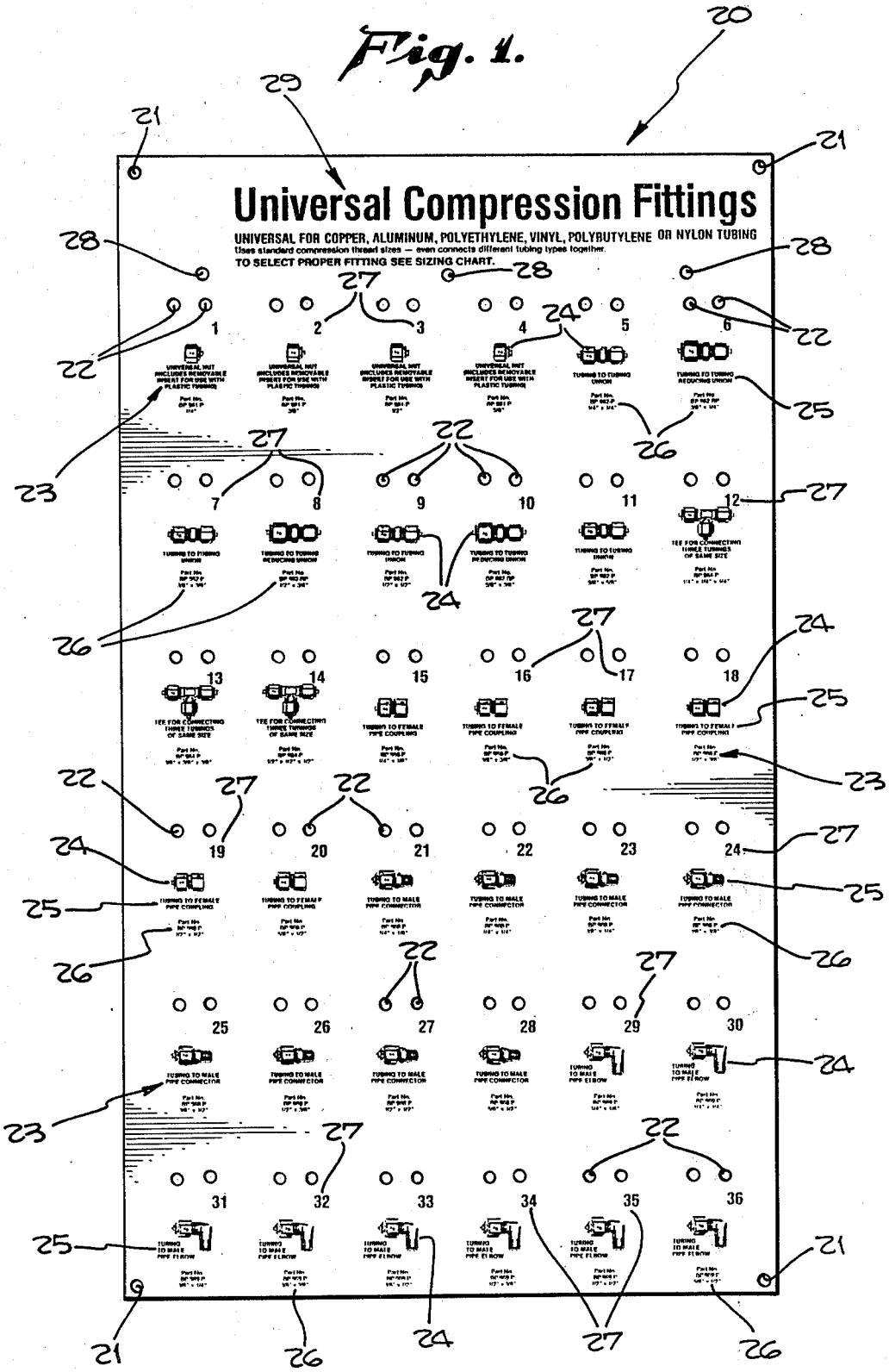
FIG. 1 is a front view of the display sheets having identifying indicia which is illustrative of a portion of the present invention.
Figure 2:
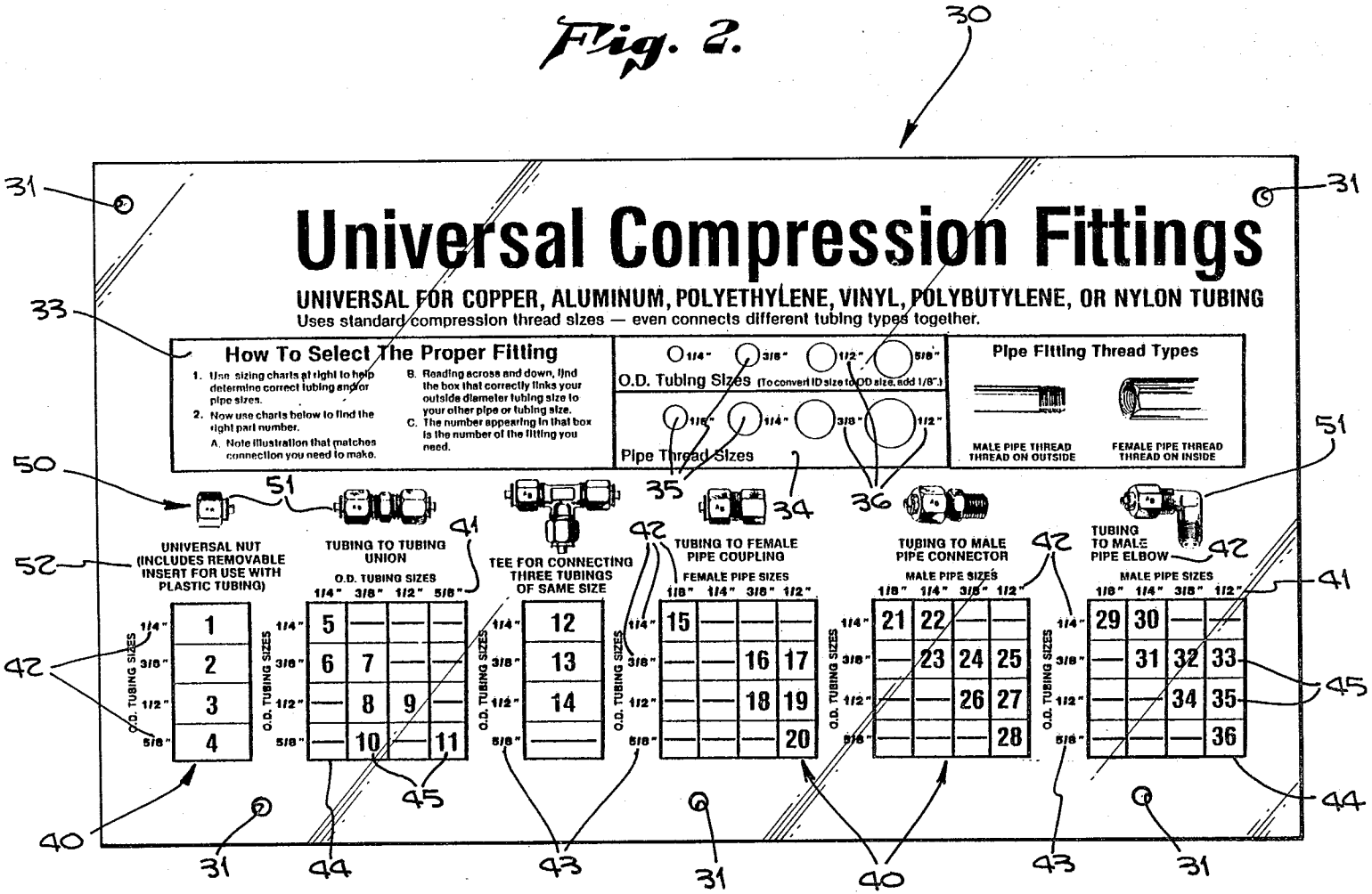
FIG. 2 is an enlarged front view of a placard which is illustrative of a portion of the present invention.
Figure 3:
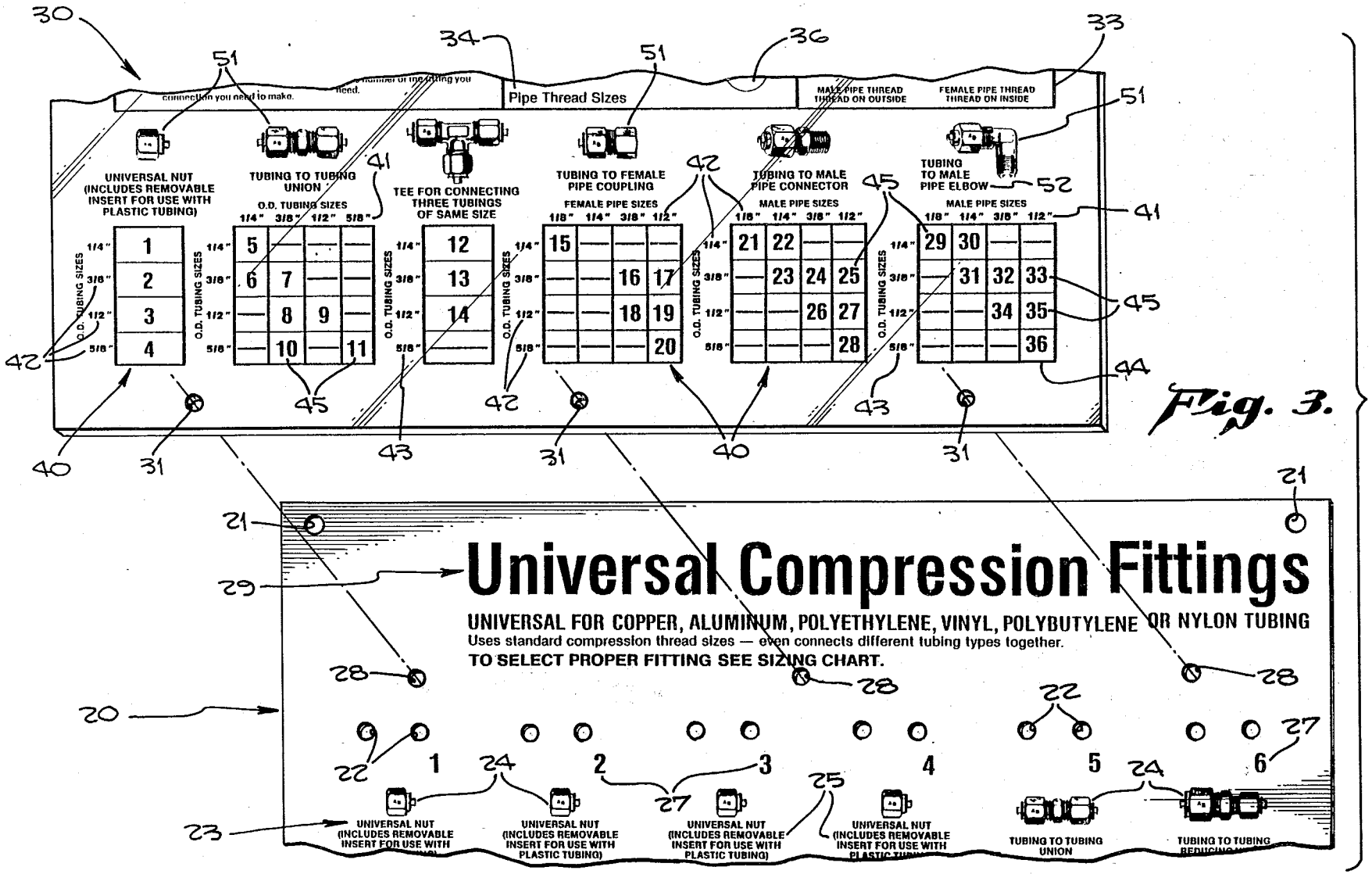
FIG. 3 is an exploded assembly view of a portion of the placard of FIG. 2 and a portion of the display sheet of FIG. 1.
Figure 4:
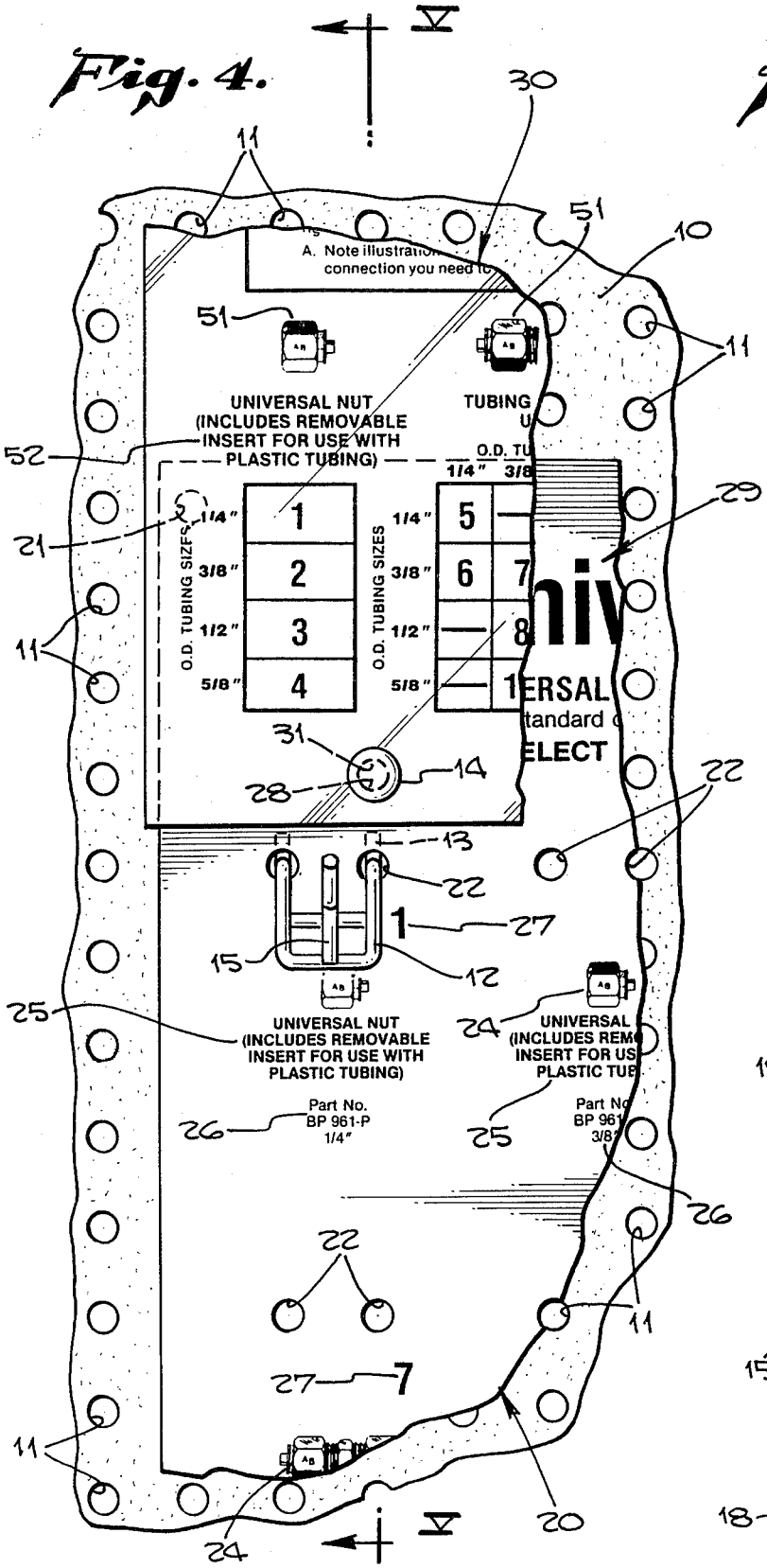
FIG. 4 is an enlarged front view of a portion of a pegboard display surface, a portion of the placard of FIG. 2, and a portion of the display sheet of FIG. 1.
Figure 5:
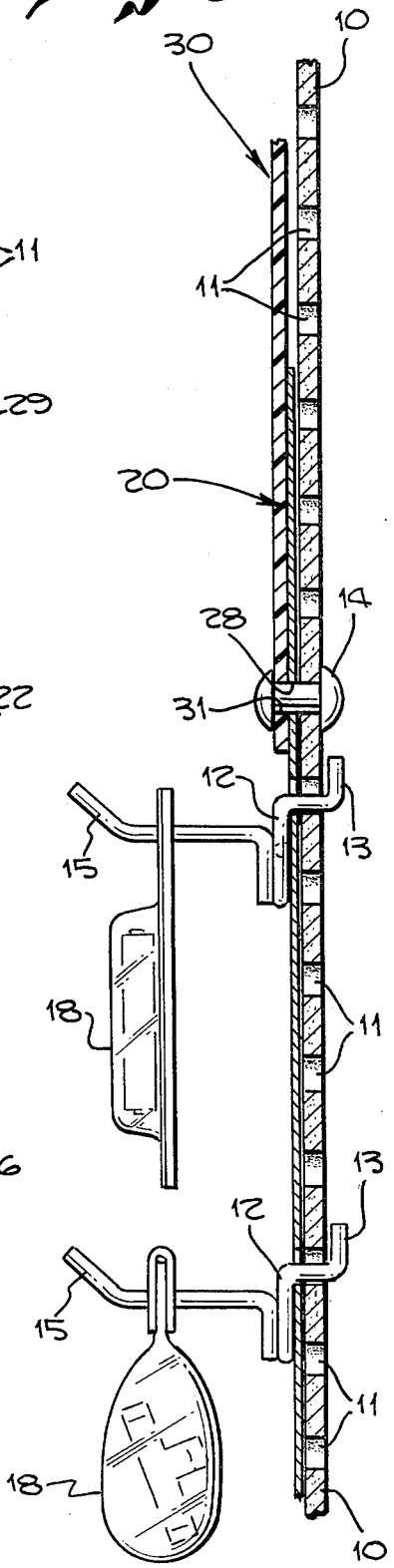
FIG. 5 is a side view of the apparatus of FIG. 4 taken in section along the line V—V of FIG. 4.

The drawings, FIGS. 1–7, show in detail a preferred embodiment of the present invention which comprises a display sheet 20 also known as a planogram and a display placard 30 also known as a header for display of merchandise 18. Said display sheet 20 and display placard 30 are particularly designed so that they may be used either separately, or mounted together as shown in FIGS. 3, 4 and 5 such that the display placard 30 is positioned over and obscures a redundant portion of display sheet 20. This juxtaposition is accomplished by fastening means 14 as are known in the art. Such fastening means 14 may include a plastic rivet as shown, a screw and nut, or other fastener mechanism that extends through an aperture in two planar members and rigidly fastens those members together.

Figure 6:
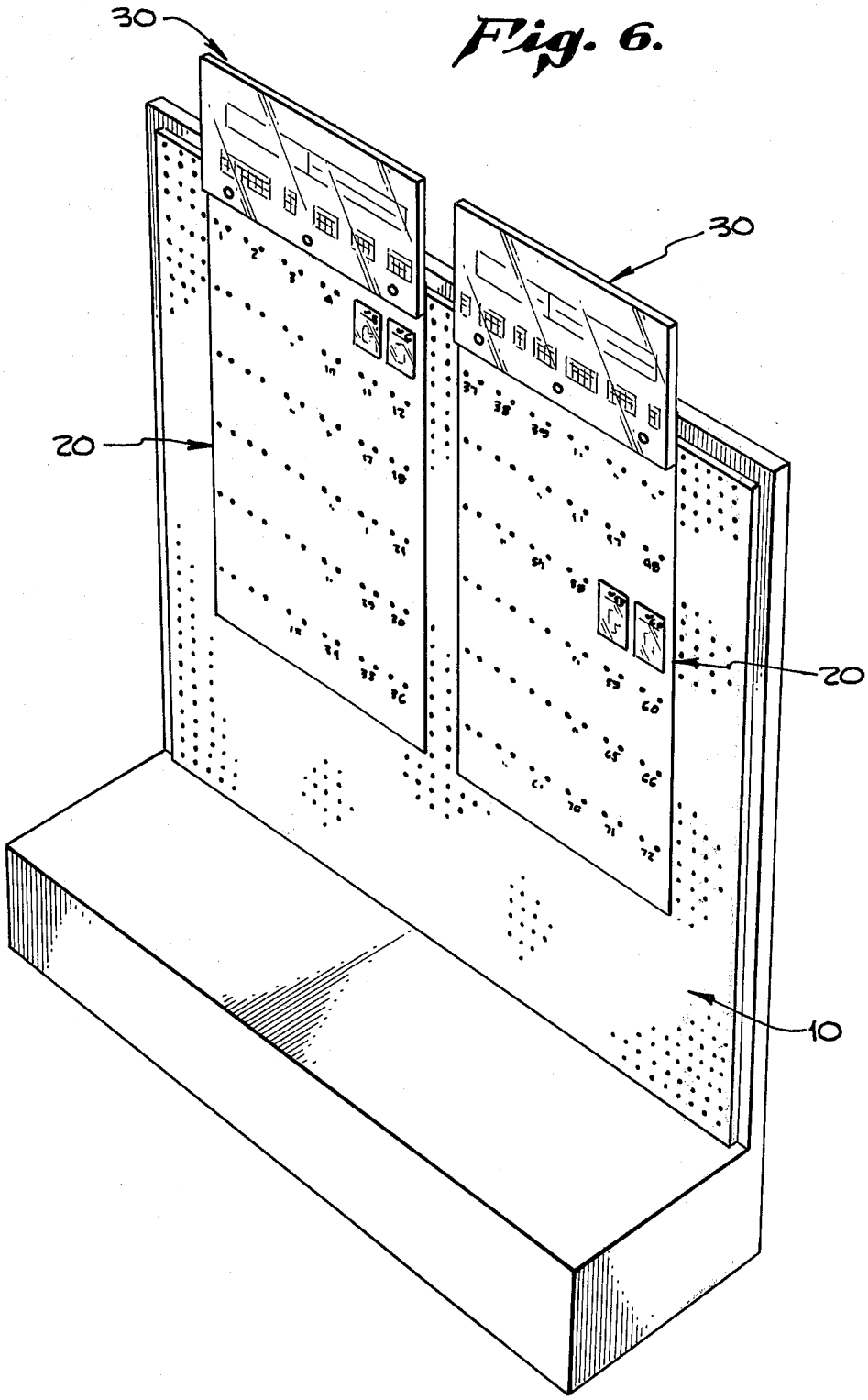
FIG. 6 is a perspective view of a pegboard display illustrating use of the present invention.
Figure 8:
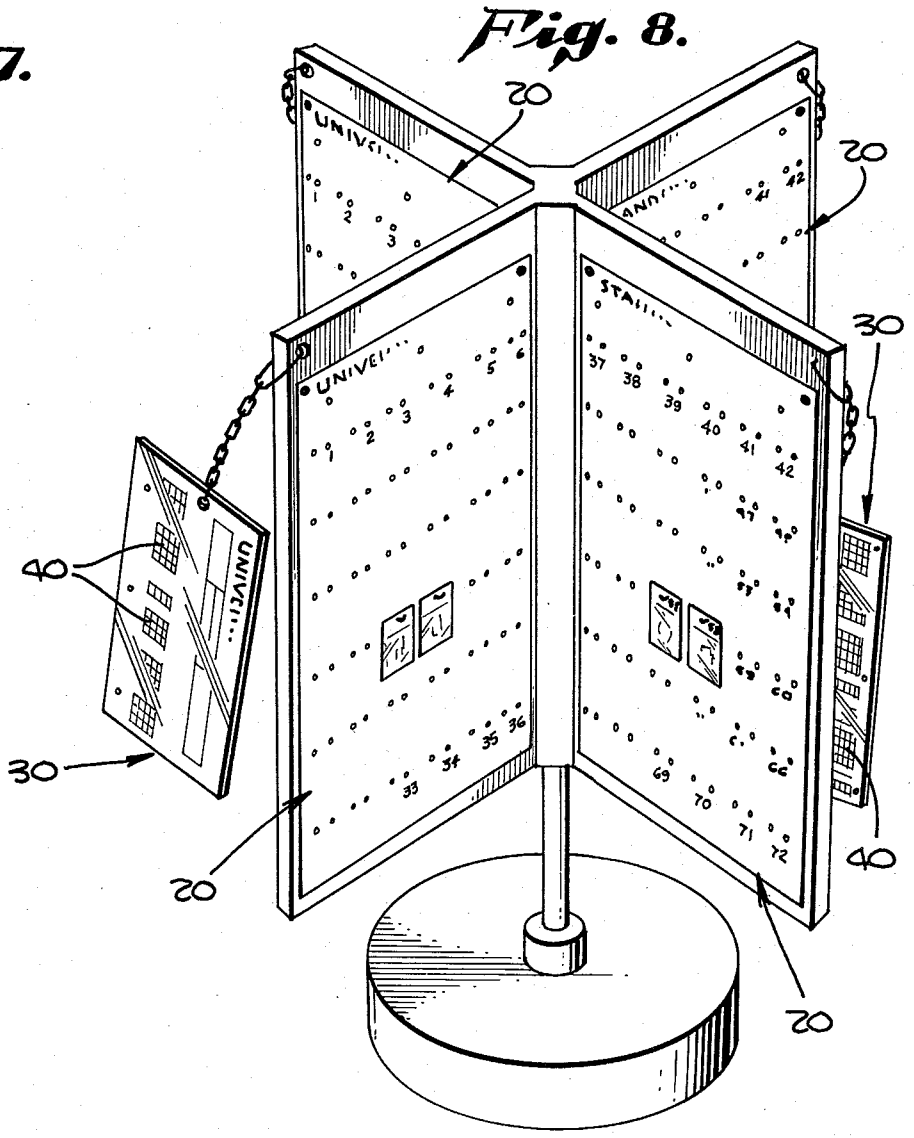
FIG. 8 is a perspective view of another pegboard display illustrating another use of the present invention.
Figure 7:
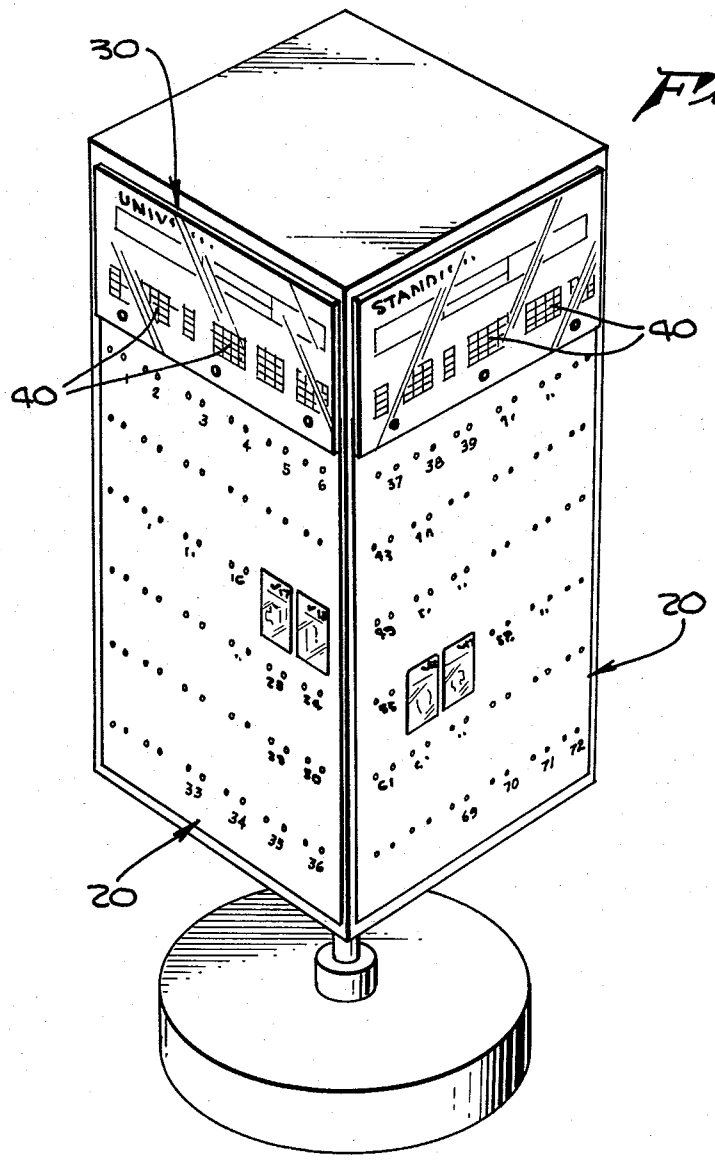
FIG. 7 is a perspective view of another pegboard display illustrating another use of the present invention.

Referring to FIG. 4, said display sheet 20 is particularly designed to be compatible with a pegboard type display wall 10 known in the art as a gondola. Said pegboard display wall 10 is typically a planar sheet formed of a fibre composite material having a $\frac{1}{8}$-3/16 inch thickness. Pegboard display walls 10 may be mounted vertically on the wall of a store as shown in FIG. 6 or may be part of a freestanding display unit. The freestanding display units 16 and 17 of FIGS. 7 and 8 are two examples. Pegboard display wall 10 contains multiple uniform holes 11 that are arranged in linear rows and columns as shown in FIG. 4. Said holes 11 are disposed throughout the pegboard display wall 10 with a standard and uniform spacing between any adjacent pair of said holes. A typical spacing of said holes is 1 inch such that said holes form rows and columns having a 1 inch spacing.

Brackets 12 for use with pegboard display walls 10 are known in the art. These brackets 12 are typically constructed of metallic wire segments which are configured to have two ends 13 of a wire segment spaced 1 inch apart such that they may be inserted in a pair of adjacent holes 11 of pegboard display wall 10. Said brackets further have a display post 15 integral with said bracket 12 and configured such that when ends 13 of said bracket are inserted through a pair of holes 11 of pegboard display wall 10 and the bracket suspended thereby, said display post 15 extends perpendicular to the pegboard display wall 10 and functions as a merchandise carrying means on which merchandise 18 may be hung and displayed.

The display sheet 20 is a pliant foldable sheet constructed of paper, plastic, or other suitable material. Said sheet is of a size sufficient to cover a significant portion of a pegboard display wall 10 which will be used for the display of a particular type of merchandise 18.

Display sheet 20 is provided with a plurality of first mounting apertures 21 which are alignable with holes 11 of a pegboard display wall 10. Fastening means 14 are inserted through first mounting apertures 21 and holes 11 thereby mounting and retaining display sheet 20 in a position which partially or completely covers pegboard display wall 10.

Display sheet 20 is further provided with merchandise display apertures 22 which are spaced throughout display sheet 20 in a predetermined manner and which are alignable with holes 11 of pegboard display wall 10 such that when display sheet 20 is mounted proximate to and overlying pegboard display wall 10 by use of mounting apertures 21, said merchandise display apertures 22 are each aligned with a respective hole 11. In this alignment, mounting ends 13 of brackets 12 may be inserted through merchandise display apertures 22 and respective holes 11 and thereby allow the display of merchandise 18 on brackets in a 12 predetermined location proximate said merchandise display apertures 22.

Referring to FIG. 1, display sheet 20 is further provided with a plurality of identifying indicia 23. In the preferred embodiment said identifying indicia 23 are each located proximate a set of one or more merchandise display apertures 22 whereby the identifying indicia 23 may identify merchandise 18 carried by one or more brackets 12 extending through said set of merchandise display apertures 22.

Each of said plurality of identifying indicia 23 are associated with merchandise 18 of common and predetermined characteristics carried by brackets 12 extending through a proximate and associated set of merchandise display apertures 22. Identifying indicia 23 more particularly includes a graphic representation 24 of the merchandise being carried. Graphic representation 24 may be photographic, artistic, schematic, or other visually representative means as are known in the art. Identifying indicia 23 may also include verbal descriptive indicia 25 which verbally describe the specific characteristics of the respective displayed merchandise 18 and numeric descriptive indicia 26 which may include a catalog parts number, sizes or dimensions, or other quantitative or numeric identifying references or descriptions.

The identifying indicia 23 of display sheet 20 is further provided with sequential selection indicia 27. More specifically, each of said identifying indicia 23 associated with merchandise 18 of particular common characteristics is provided an associated sequential selection indicia 27. In the preferred embodiment, the sequential selection indicia 27 comprises numeric designations of the merchandise 18 carried on brackets 12 mounted through a particular set of merchandise display apertures 22. These numeric designations are arranged substantially sequentially throughout the display sheet 20 such that sets of display brackets 12 carrying merchandise 18 of common characteristics are consecutively numbered thereby making numerically identified merchandise easily locatable.

Display sheet 20 is further provided with a plurality of second mounting apertures 28 for use with display placard 30, as will be further described, and general identifying indicia 29 which comprises graphic identification of the general characteristics of the merchandise displayed on display sheet 20. Such information may include the manufacturer, a generic title of the merchandise displayed, a description of the environments of usage of the merchandise and a reference to display placard 30 for selecting merchandise.

Referring to FIGS. 3, 4 and 5, display placard 30 is comprised of a sheet or card constructed of rigid cardboard, plastic, or other suitable material. Said placard 30 may be of a size sufficient to cover an upper portion of display sheet 20 thereby covering and obscuring from view the portion of said display sheet 20 which contains said general identifying indicia 29.

Display placard 30 is provided with a plurality of mounting apertures 31 which are alignable with said second mounting apertures 28 of display sheet 20 and may also be alignable with holes 11 of pegboard display wall 10. Fastening means 14 are inserted through said mounting apertures 31 of display placard 30 and said second mounting apertures 28 of said display sheet 20 thereby mounting and retaining display placard 30 in a position which partially overlies and obscures from view a portion of display sheet 20. Said fastening means 14 may, additionally, insert through holes 11 of display wall 10 thereby mounting and retaining display placard 30 and display sheet 20 in a predetermined position rigidly fixed on display wall 10.

Display placard 30 is further provided with general identifying indicia 32 similar to the general identifying indicia 29 of display sheet 20. Said general identifying indicia 22 serve to identify the manufacturer and general characteristics of the merchandise displayed by the associated display sheet 20.

Referring primarily to FIG. 2, display placard 30 is further provided with instruction indicia 33 for instructing a customer on how to select the desired merchandise using display placard 30, display sheet 20 and sizing means 34. Sizing means 34 comprises graphic facsimiles 35 of the various sizes of end configurations for either tubing, pipe or couplings. Said facsimiles 35 may be photographic, line drawing, or other graphic representation of the various sizes of one characteristic of the desired merchandise or its environment of intended usage. Each of said facsimiles 35 in said sizing means 34 has an associated sizing indicia 36 located proximate to the respective facsimile 35. Said sizing indicia 36 may comprise an alphanumeric designation of the size or dimension of merchandise graphically displayed by facsimile 35. In the preferred embodiment, said facsimiles 35 are graphic depictions of tubing or pipe thread cross-sections and said sizing indicia 36 are numberic references to the measured diameter of said facsimile 35, said sizing indicia 36 being measurements of diameter described in fractions of an inch.

Display placard 30 is further provided with a matrix of indicia 40 having a first axis 41 comprising varying requirement indicia 42 associated with a first characteristic of the displayed merchandise 18, a second axis 43 comprising varying requirement indicia 42 associated with a second characteristic of the displayed merchandise, and a body 44 comprising rows and columns of selection indicia 45. The requirement indicia 42 of said first and second axes 41 and 43 correspond with the sizing indicia 36 of sizing means 34 and also comprise a measured dimension or size characteristic of the displayed merchandise 18. The selection indicia 45 located in the body 44 of the matrix 40 corresponds with the sequential selection indica 27 of display sheet 20.

The foregoing matrix 40 may be repeated for each configuration of available merchandise. Accordingly, each matrix 40 may be provided with configuration indicia 50 which may include a facsimile 51 of the configuration associated with said matrix 40. Said facsimile 51 comprises a graphic representation of the merchandise configuration and may be photographic, line drawing, schematic, or other representation form as is known in the art. Configuration indicia 50 may also include verbal descriptive indicia 52 which verbally describes the characteristics of the configuration of merchandise 18 associated with said matrix 40.

In use, merchandise 18 of desired characteristics may be selected by locating the requirement indicia 42 associated with a first characteristic of said merchandise along the first axis 41 of matrix 40, a second requirement indicia 42 indicating a second desired characteristic of the displayed merchandise 18 is located along second axis 43 of matrix 40 and a particular selection indicia 45 is located within the body 44 of matrix 40 that lies in the column indicated by the requirement indicia 42 associated with the first desired characteristic along first axis 41 and in the row indicated by the requirement indicia 42 associated with the second characteristic of the desired merchandise 18 along second axis 43. The selection indicia 45 so indicated corresponds with the sequential selection indicia 27 associated with the particular display post 15 carrying merchandise 18 having the desired first and second characteristics.

One particular application of the present invention is the display and selection of plumbing fittings. In this application, merchandise 18 is a plumbing fitting which may have one, two or three ends and be either a straight or elbow connection, thus comprising multiple configurations of displayed merchandise. A primary characteristic associated with the selection of plumbing is the size or dimension of each end of the fitting and each of these may vary independently of the other. In this manner, the facsimiles 35 of sizing means 34 may comprise circular representations of the diameter or cross-section of either the pipe to be fitted or the particular fitting end to be replaced. The associated sizing indicia 36 is a numeric indication of the measurable diameter of said pipe, tubing or fitting end represented by the respective facsimile 35, and in this example is measured in fractions of an inch.

A different matrix 40 may be provided for each configuration of plumbing fitting. For example, one matrix may relate to a tubing to male pipe straight couplings in which one end of the particular fitting is adapted to receive tubing, the other end is adapted to receive a female threaded pipe, and the particular fitting is a straight connection of said tubing and pipe. For this coupling, the first characteristic is the size of tubing to be fitted onto the first end of the fitting and the second characteristic is the size of the pipe to be fitted to the other end of the fitting. The particular matrix 40 desired may be located by referring to the configuration indicia 50 for either a graphic or facsimile 51 display of the desired fitting or a verbal descriptive indicia 52 of the desired fitting. Once the matrix 40 associated with this particular configuration is located, the size of the tubing to be joined to one end of the union may be located in the first axis 41 of matrix 40 among the available requirement indicia 42 of tubing sizes and the size of the pipe end to be joined by the coupling may be selected from the requirement indicia 42 of the second axis 43 of matrix 40. Selection indicia 45 can be located in the body 44 of matix 40 in the row and column associated with the requirement indicia 42 of the first axis 41 and the requirement indicia 42 of the second axis 43, respectively. The selection indicia 45 so indicated is a number corresponding with a display post 15 of a bracket 12 of display wall 10 identified by an identical number, the sequential selection indicia 27 proximate to said bracket 12. In this manner, the desired plumbing fitting is located among the fittings available and displayed by display wall 10.

Although the apparatus and system for the display and selection of merchandise described above was primarily intended for use with plumbing fittings, it could also be used for the selection of other types of merchandise in the retail setting. It is further contemplated that this apparatus and system could have other applications for the selection of any multiple characteristic object of choice.

Although this apparatus and system for the display and selection of merchandise has been described in detail, it is to be understood that various modifications thereof can be made by one skilled in the art and still come within the scope and spirit of the present invention which is only limited as defined by the following claims.

What is claimed is:

1. In apparatus for the display and selection of merchandise, said merchandise having a plurality of identifying characteristics and including:

a display surface for displaying merchandise;

multiple merchandise carrying means mounted to said display surface for carrying displayed merchandise, each of said merchandise carrying means carrying merchandise having common characteristics;

multiple merchandise identifying indicia located on said merchandise said identifying indicia being associated with said common characteristics; and an identifying placard mounted to said display surface and having indicia generally identifying the merchandise displayed by said display surfaces; the improvement in selection means carried by said placard comprising:

a matrix of indicia, said matrix having a first axis comprising requirement indicia associated with one characteristic of the displayed merchandise, a second axis comprising requirement indicia associated with another characteristic of the displayed merchandise; and a body comprising selection indicia aligned with said requirement indicia and corresponding with said merchandise identifying indicia;

whereby merchandise of predetermined characteristics can be selected from the displayed merchandise by locating the requirement indicia corresponding with each of said predetermined characteristics along the respective axis of said matrix determining the selection indicia of said matrix associated with said requirement indicia, and the selecting the merchandise identified by the merchandise identifying indicia corresponding with said selection indicia of said matrix.

2. The apparatus for the display and selection of merchandise of claim 1 wherein:

one of said characteristics of said displayed merchandise is the configuration of one portion of said merchandise, said configuration being determinant of whether the merchandise is capable of functioning compatibly within the environment of its intended use; and said selection means includes the provision of configuration indicia comprising multiple facsimiles of said portion in varying predetermined configurations, requirement indicia associated with said predetermined configurations located proximate the respective facsimile of said portion of said predetermined configuration and corresponding with said requirement indicia of at least one of said axes of said matrix;

whereby replacement merchandise having at least one characteristic similar to merchandise to be replaced can be selected by locating the facsimile of the merchandise configuration which appears similar to the configuration of said merchandise to be replaced and determining the requirement indicia located proximate to and associated with said facsimile for use with said matrix.

3. The apparatus for the display and selection of merchandise of claim 2 wherein:

said requirement indicia of at least one axis of said matrix includes a facsimile of the predetermined configuration of one portion of said merchandise associated with the selection indicia in said matrix.

4. The apparatus for the display and selection of merchandise of claim 1 wherein said selection means includes the provision of two or more of said matrices, each of said matrices corresponding with a predetermined generic type of merchandise, said generic type comprising merchandise having at least two common characteristics.

5. The apparatus for the display and selection of merchandise of claim 4 wherein said merchandise comprises plumbing fittings; said characteristics comprise the configuration and size of each end of said plumbing fitting; said generic types comprise predetermined pairs of fitting end configurations; and said requirement indicia comprises sizes of the respective ends of the generic type of plumbing fitting.

6. The apparatus for the display and selection of merchandise of claim 1 wherein:

one of said characteristics of said displayed merchandise is the size of one portion of said merchandise; and said selection means includes the provision of sizing means comprising multiple facsimiles of said portion in varying predetermined sizes with sizing indicia associated with said predetermined sizes located proximate the respective facsimile of said portion of said predetermined sizes and corresponding with said requirement indicia of at least one of said axes of one of said matricies;

whereby replacement merchandise having at least one portion having a size similar to merchandise to be replaced can be selected by locating the facsimile of the merchandise portion having a size which appears similar to the size of said merchandise to be replaced and determining the sizing indicia located proximate to and associated with said facsimile for use with said matrix to locate said merchandise on said display surface.

7. In apparatus for the display and selection of merchandise, said merchandise having a plurality of identifying characteristics, said apparatus including:

a display surface for displaying merchandise;

multiple merchandise carrying means mounted to said display surface for carrying displayed merchandise, each of said merchandise carrying means carrying merchandise having common characteristics;

multiple merchandise identifying indicia located on said merchandise, said identifying indicia being associated with merchandise having predetermined common characteristics; and an identifying placard having indicia generally identifying the merchandise displayed by said display surface;

the improvement in selection means carried by said placard and comprising:

multiple arrays of indicia, one of said arrays having a column of requirement indicia associated with one characteristic of the displayed merchandise, a second of said arrays including a column of requirement indicia associated with another characteristic of the displayed merchandise; and said multiple merchandise identifying indicia comprising permutations of the requirement indicia associated with the one characteristics of the displayed merchandise and the requirement indicia associated with the other characteristic of the displayed merchandise;

whereby merchandise of predetermined characteristics can be selected from the displayed merchandise by locating the requirement indicia corresponding with each of the said predetermined characteristics among the respective arrays to determine the combination of requirement indicia which corresponds with the identifying indicia associated with the desired characteristics of the merchandise, and by selecting the merchandise identified by the merchandise identifying indicia.

8. In an apparatus for the display and selection of merchandise, and merchandise having a plurality of identifying characteristics, said apparatus including:

a display surface for displaying merchandise;

a multiple merchandise carrying means mounted to said display surface for carrying displayed merchandise, each of said merchandise carrying means carrying merchandise having common characteristics;

multiple merchandise identifying indicia located proximate said merchandise, said identifying indicia being associated with predetermined common characteristics of the respective merchandise carried by said merchandise carrying means; and an identifying placard associated with said display surface and having indicia generally identifying the merchandise displayed by said display surface; the improvement comprising the provision of improved selection means carried by said placard and comprising:

a first array having multiple actual size representations of one variable characteristic of the displayed merchandise and corresponding requirement indicia associated with said variations of said one characteristic of the displayed merchandise;

a second array having multiple representations of another variable characteristic of the displayed merchandise and corresponding requirement indicia associated with said variations of said another characteristic of the displayed merchandise; and merchandise carried by said multiple merchandise carrying means and associated with said identifying indicia, said identifying indicia being a permutation of the requirement indicia associated with said one variable characteristic of the displayed merchandise and the requirement indicia associated with the other variable characteristic of the displayed merchandise, whereby said merchandise is identified and selected by the identification of the requirement indicia associated with the variable characteristics of the displayed merchandise.

* * * * *